US008770425B2

(12) United States Patent
Schley et al.

(10) Patent No.: US 8,770,425 B2
(45) Date of Patent: Jul. 8, 2014

(54) BEVERAGE CAN LID

(75) Inventors: Alexander Schley, Bamberg (DE); Arnoulf Keil, Bad Homburg v.d.H. (DE)

(73) Assignee: Canrec AG, Zug (CH)

( * ) Notice: Subject to any disclaimer, the term of this patent is extended or adjusted under 35 U.S.C. 154(b) by 0 days.

(21) Appl. No.: 12/997,383

(22) PCT Filed: Jun. 3, 2009

(86) PCT No.: PCT/EP2009/003940
§ 371 (c)(1),
(2), (4) Date: Jun. 16, 2011

(87) PCT Pub. No.: WO2009/149846
PCT Pub. Date: Dec. 17, 2009

(65) Prior Publication Data

US 2011/0240645 A1 Oct. 6, 2011

(30) Foreign Application Priority Data

Jun. 12, 2008 (CH) ..... 890/08

(51) Int. Cl.
*B65D 51/18* (2006.01)
*B65D 17/34* (2006.01)
*B65D 43/18* (2006.01)

(52) U.S. Cl.
USPC ..... 220/254.4; 220/254.1; 220/269; 220/820; 220/821; 220/906

(58) Field of Classification Search
USPC ..... 220/269, 254.4, 820, 821, 254.1, 906
See application file for complete search history.

(56) References Cited

U.S. PATENT DOCUMENTS

| | | | | |
|---|---|---|---|---|
| 3,622,055 | A * | 11/1971 | Douty | 222/541.9 |
| 6,347,720 | B1 | 2/2002 | Schley | |
| 2003/0102313 | A1* | 6/2003 | Weber | 220/254.4 |
| 2004/0259235 | A1* | 12/2004 | Fares et al. | 435/287.1 |
| 2006/0016815 | A1* | 1/2006 | Rieck et al. | 220/269 |
| 2007/0187406 | A1* | 8/2007 | Nobile et al. | 220/254.4 |

FOREIGN PATENT DOCUMENTS

| | | |
|---|---|---|
| DE | 298 12 116 | 11/1998 |
| WO | 97/36795 | 10/1997 |
| WO | 2005/026004 | 3/2005 |

* cited by examiner

*Primary Examiner* — Fenn Mathew
*Assistant Examiner* — Don M Anderson
(74) *Attorney, Agent, or Firm* — Michael J. Striker

(57) ABSTRACT

A beverage can with a rotating lid (2) is attached to a rivet (5) in the can lid (D) and can be turned from an open rotating position to a closed rotating position above the pouring opening (7) and back. The rotating lid (2) at least partially takes the form of a bent snap disk (S) that can be moved by the application of force perpendicular to the lid plane, which bends the disk past a trigger point, from a stable first bending state into a stable second bending state in which the outer rim (10) of the rotating lid (2) is pressed against the rim lid (9) that delimits the pouring opening (7) with a certain closing pressure. The snap disk (S) moves back into its first bending state by re-applying force.

16 Claims, 3 Drawing Sheets

BEVERAGE CAN LID

CROSS-REFERENCE

The invention described and claimed hereinbelow is also described in PCT/EP20009/003940, filed on Jun. 3, 2009 and Swiss Application 890/08, filed Jun. 12, 2008. This Swiss Patent Application, whose subject matter is incorporated here by reference, provides the basis for a claim of priority of invention under 35 U.S.C. 119 (a)-(d).

BACKGROUND OF THE INVENTION

The invention relates to the seal for a beverage can based on a rotating lid that can be turned around a rivet in the can lid from an open rotating position to a closed rotating position above the pouring opening and back.

SUMMARY OF THE INVENTION

This invention has the purpose of improving such beverage can seals with regard to sealing function and ease of use.

For this purpose, the rotating lid at least partially takes the form of a bent snap disk, which can be moved by the use of force applied perpendicular to the lid plane, which bends the lid past a trigger point, from a stable first bending state to a stable second bending state, in which the outer rim of the rotating lid presses against the lid rim that delimits the pouring opening with increased closing pressure. The snap disk returns to the first bending state after renewed application of force (snap-action effect). Increased closing pressure may, for example, be achieved when the rotating lid is less bent in the second bending state and therefore has a slightly larger outside diameter than in the first bending state.

It is therefore possible that, in the second bending state, the rotating lid extends slightly below or above the can lid or interlocks with it, for example when the lid rim area delimiting the pouring opening is groove-shaped.

It is advantageous for the operation of the snap disk when the rotating lid is attached to a rivet with a fastening tab that extends beyond the rivet as seen from the snap disk and forms an operating element on the opposite side.

Another version of the invention relates to a seal of the kind described above with a press-in tab used for opening, which is fastened above the rotating lid to the same rivet in the can lid to which the rotating lid is fastened. When the rotating lid is in the sealing position, it is held against the lid rim that delimits the pouring opening by the press-in tip of the press-in tab, which is pulled up at the end opposite to the press-in tip and is supported and latched against the can lid.

The rotating lid can retain this sealing position in a particularly reliable manner when a support is hinged to the end of the press-in tab opposite the press-in tip, which can latch downwards into a notch in the can lid once the pouring opening has been pressed open and the rotating lid has been turned over the pouring opening with the end of the press-in tab opposite the press-in tip pulled up, so that the rotating lid, which has been moved to the closed rotating position, is pressed against the can lid rim that delimits the pouring opening by the press-in tip of the press-in tab. This already creates a generally reliable seal between the rotating lid and the can lid in a closed rotating position.

The support described above is preferably made of the same piece as the press-in tab and partially cut out of it to simplify production. The support may be connected to the press-in tab by a folded edge at the end opposite the rivet to make it easier to keep the support at an angle to the press-in tab. Effective latching of the press-in tab in a sealing position is achieved by making the length of the support smaller than approx. half the length of the press-in tab and larger than approx. one third of the length of the press-in tab. The notch in the can lid, which is in all versions preferably below the press-in tab in the can lid, for example in the form of a rib or groove, is in this case located at approx. half to one third of the length of the press-in tab as seen from the end of the press-in tab. The angle of the lifted press-in tab to the can lid plane in a closed and latched position is preferably between 30 and 45°.

The press-in tab can be connected to the rivet by a fastening tab that is partially cut out of the press-in tab material.

To simplify production, the rivet and/or the notch are shaped from the material of the can lid.

A further development of the invention has a can lid with a guide groove for taking up a protrusion at the bottom of the rotating lid. The rotating lid can therefore be reliably moved from its opening rotating position—which is at the back as seen from the pouring opening—to its closed rotating position in front. This facilitates handling.

The rotating lid may have reinforcement corrugations near the rivet, next to it or on the side opposite the press-in tip to absorb the material stress in these areas.

The can lid may further have a limit stop for the rotating lid in a sealing position to make it easier to close the pouring opening.

The sealing function can be further improved when the rotating lid is, at least partially, coated with sealing material, e.g. on the inside of its rim area.

Operation can also be simplified when the outer rim of the rotating lid has one or several fins or similar grip areas so that it is easier to hold the rotating lid for turning.

The material should be selected to ensure that the material thickness of the can lid is preferably between 0.1 and 0.3 mm, in particular approx. 0.224 mm, that the material thickness of the press-in tab is preferably between 0.15 and 0.35 mm, in particular approx. 0.265 mm and that the material thickness of the rotating lid is preferably between 0.05 and 0.15 mm, in particular approx. 0.1 mm. The material may be rolled aluminium, possibly covered with a clear lacquer.

The invention further relates to a can lid with a seal as described above as well as to a beverage can with a can lid built in this way.

Additional goals, characteristics, advantages and application options of the invention result from the following description of embodiments based on drawings. All characteristics described and/or depicted are individually and in any combination part of the invention, independently of the way they are summarised or referenced in the individual claims.

DETAILED DESCRIPTION OF THE PREFERRED EMBODIMENTS

Figure 1B:
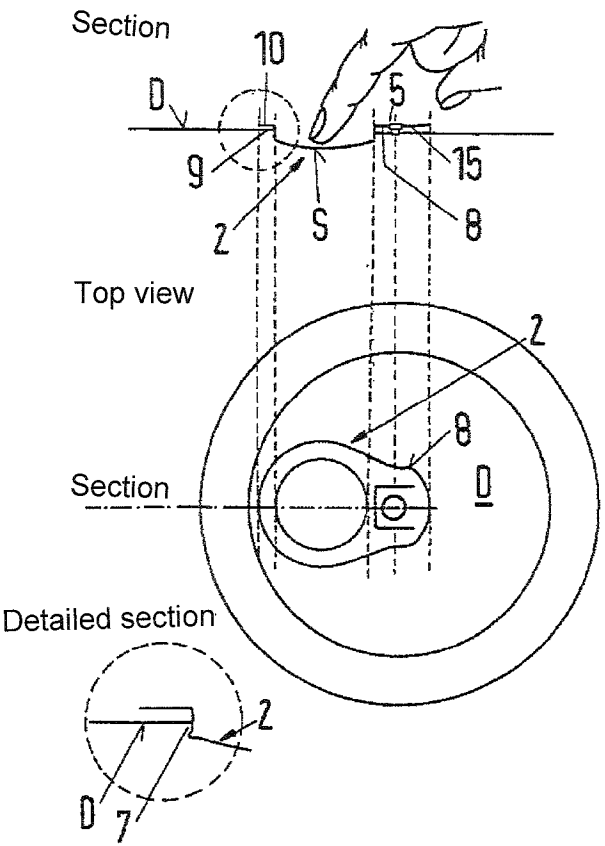
FIG. 1*b* Drawings according to FIG. 1*a* in which the snap disk of the rotating lid is in the second bending state and the operation for transferring the snap disk from its first bending state shown in FIG. 1*a* to its second bending state is illustrated.

The sealing system according to FIGS. 1*a* to 1*d* makes it possible to re-seal beverage cans with pouring openings that are built as press-in openings. The can lid D, which may, for example, be permanently flanged onto the top of an approx. cylindrical can body K, has a rivet 5 on which the rotating lid 2 is fastened in a rotatable manner so that it can be turned from an open rotating position into a closed rotating position above the pouring opening 7 and back. FIGS. 1*a* to 1*d* all show the rotating lid 2 in its closed rotating position above the pouring opening 7, which has previously been pressed open, for example by using pre-weakened lines in the material.

The rotating lid 2 is at least partially shaped as a bent snap disk S that can be moved by the application of force perpendicular to the lid mirror plane, which bends the disk past a trigger point, from a stable first bending stated to a stable second bending state in which the outer rim 10 of the rotating lid 2 rests with a certain closing pressure against the lid rim 9 that delimits the pouring opening 7. The disk can be moved back to the first bending state by re-applying force as illustrated in FIGS. 1*a* to 1*d*. FIGS. 1*a* to 1*d* show an implementation in which the snap disk S covers the main part of the pouring opening and has an outside contour that is adapted to the inner rim of the pouring opening 7, which is circular in this particular case.

Figure 1A:
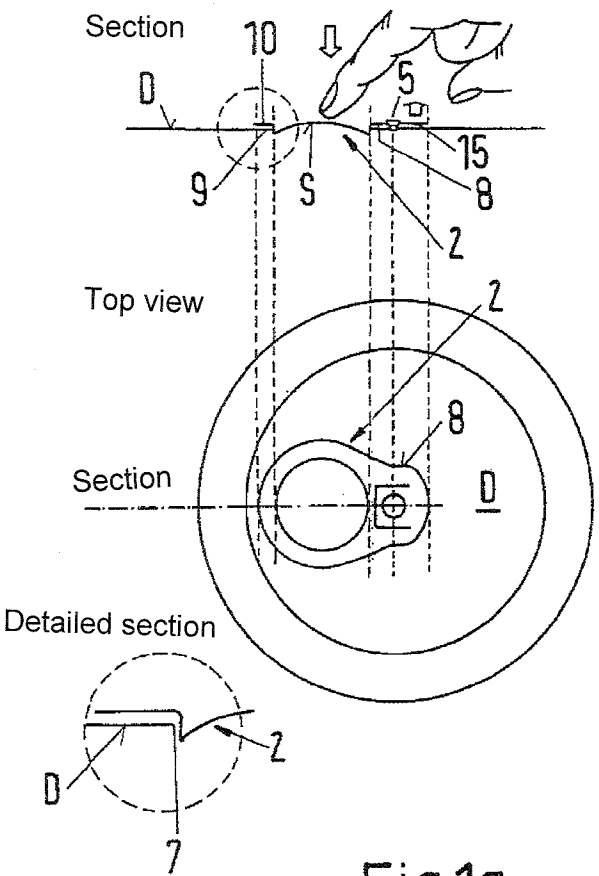
FIG. 1*a* A beverage can lid seal according to the invention in top view, section view and detailed section view, where the snap disk is shown in its closed rotating position and in the first bending state.

The rotating lid 2 overlaps slightly with the lid rim 9 of the pouring opening 7. A comparison of FIGS. 1*a* and 1*b* shows that the snap disk area of the rotating lid 2, which in FIG. 1*a* fits into the pouring opening 7 with slight play, is pressed tightly against the lid rim 9 that delimits the pouring opening 7 along its entire circumference after being bent downwards, as is shown in FIG. 1*b*.

Figure 1D:
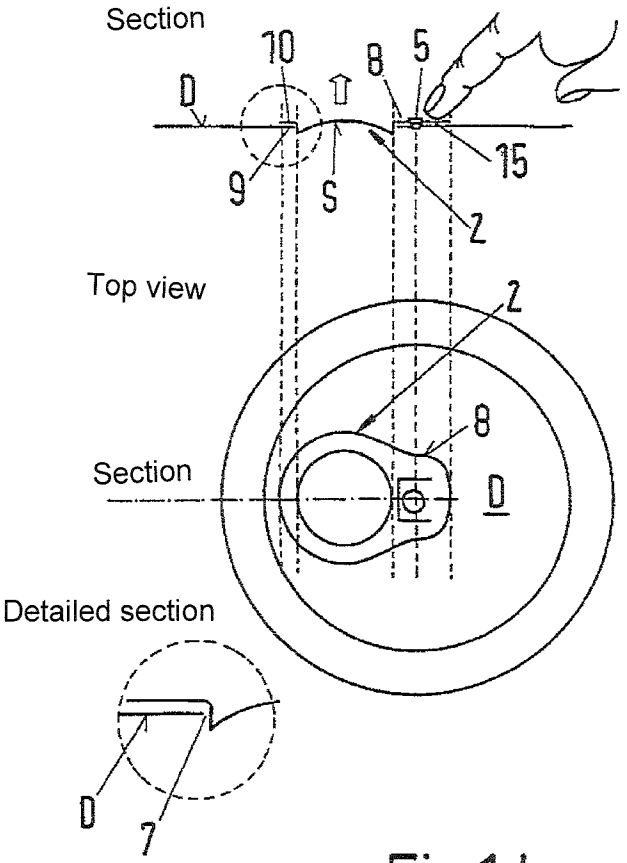
FIG. 1*d* Drawings according to FIG. 1*a*, illustrating in conjunction with FIG. 1*c* how the snap disk is moved from its second bending state to its first bending state.
Figure 1C:
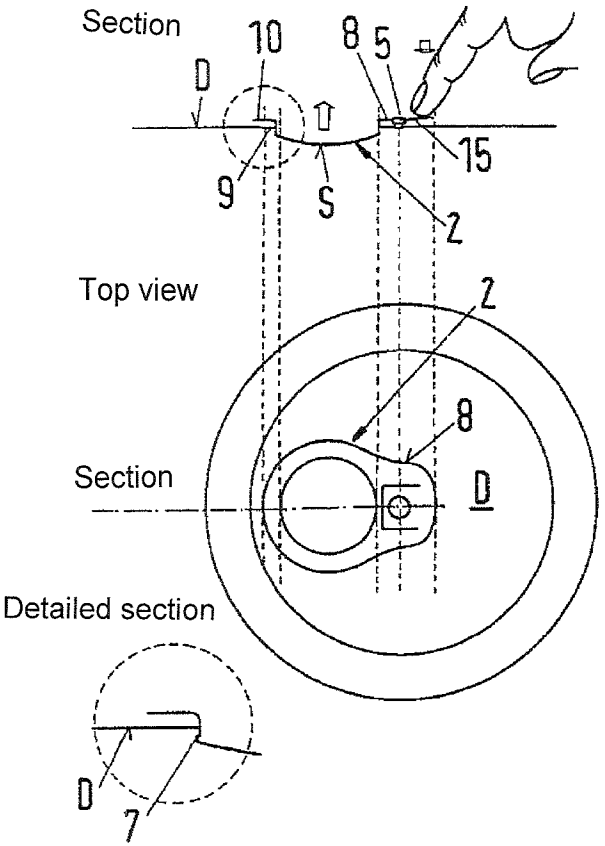
FIG. 1*c* Drawings according to FIG. 1*b*.

The rotating lid 2 is fastened to the rivet 5 of the can lid D by a fastening tab 8. The fastening tab 8 extends beyond rivet 5 as seen from the snap disk S to form an operating element 15 on the other side. A comparison of FIGS. 1*c* and 1*d* shows that pressure from the top onto operating element 15 can move the snap disk S from its second, tightly sealing bending state to its first bending state in which the rotating lid 2 can easily be turned away from the pouring opening 7.

Figure 2A:
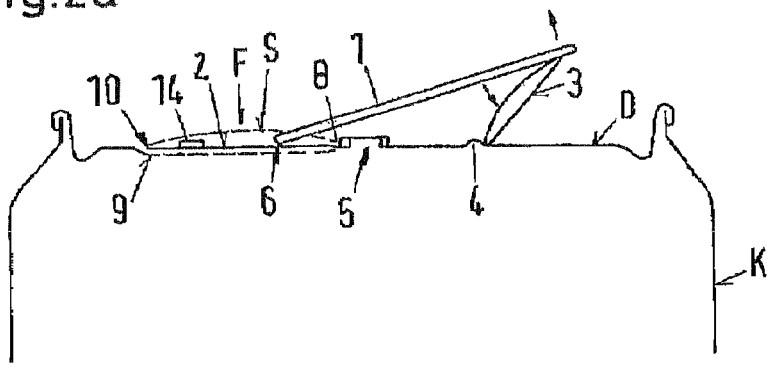
FIG. 2*a* Schematic side view of another sealing system according to the invention, which is flanged to an approx. cylindrical can body and shows the rotating lid in a closed position and the support in a latched position, and FIG. 2*b* Top view of a can lid with the rotating lid in an open rotating position.
Figure 2B:
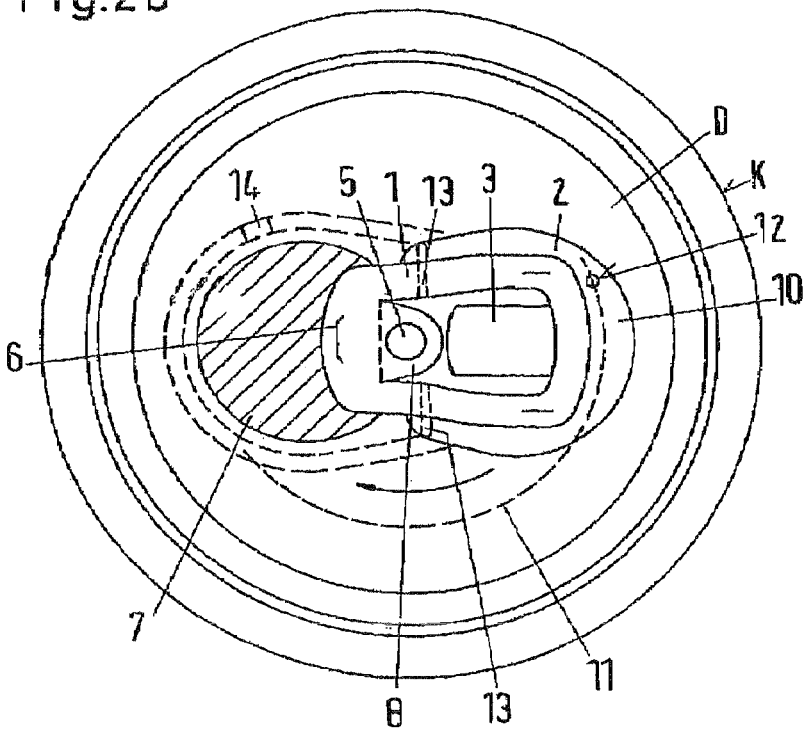

The sealing system according to the invention as shown in FIGS. 2*a* and 2*b* can be used to re-seal beverage cans with pouring openings 7 formed as press-in openings in a more reliable way. The can lid D, which may, for example, be permanently flanged onto the top of an approximately cylindrical can body K, usually has a press-in tab 1 that is connected to a rivet 5 shaped from the can lid D by a fastening tab 8. The rotating lid 2 is also attached to the same rivet 5, so that it can be turned around rivet 5 and moved to its closed position after the pouring opening 7 has been opened by lifting the press-in tab 1 at its end opposite the pouring opening 7 and by pressing the press-in tip 6 in front onto the pre-weakened lid area. After turning the rotating lid 2 from the open rotating position shown in FIG. 2*b* to the closed rotating position shown in FIG. 1 while moving the protrusion 12 at the bottom of the rotating lid 2 into a guide groove 11 in the can lid D up to the limit stop 14 of the can lid D, a support 3 hinged to the outer end of the press-in tab 1 can be bent in direction of the can lid D and moved to a latching position in notch 4 of the can lid D. In this latched position, the press-in tab 1 presses onto the rotating lid 2 in its closed position with its press-in tip 6 and secures it against the lid rim 9 that delimits the pouring opening 7, using the spring tension of the press-in tab 1 and the support 3 in such a way that a reasonable seal is created.

The dotted lines in FIG. 1 show that the rotating lid 2 partially takes the form of a snap disk S, which can be moved by the application of force perpendicular to the lid plane, which bends the disk past a trigger point, from an upper stable bending state to a lower bending state in which the outer rim 10 of the rotating lid is pressed against the lid rim 9 delimiting the pouring opening 7 with more force than in the other bending state to create a tight seal. The upward bend of the snap disk S in the initial position may be stronger than the downward bend of the snap disk S in the second stable bending state, so that the diameter of the rotating lid 2 in the latter, second bending state is slightly bigger than in the first bending state, in which the snap disk is bent upwards. When the snap disk area of the rotating lid is again pressed perpendicular to the lid plane, the snap disk S can snap back into its initial position, in which it is bent upwards.

After drinking from the beverage can, it can simply be resealed so that no insects or dirt can get into the can. The reliable seal ensures that none of the remaining drink can leak out, e.g. when the can is packed into a rucksack. The can is re-opened by turning the press-in tab slightly sideways until the support 3 detaches from the notch 4. Once the snap disk S has been transferred to its upward-bent initial position, the rotating lid 2 can be turned to its open rotating position.

The pouring opening 7 and the fitting rotating lid 2 in the example shown are circular. However, they can also be oval or trapezoidal, possibly with rounded corners, or have any other shape. The rotating lid 2 may, in particular, have one or several fins or similar gripping elements at its outer rim 10 (not shown), to make it easier to grip the rotating lid 2 for turning.

The material thickness of the press-in tab 1 can be slightly lower than that of the can lid D and the material thickness of the rotating lid 2 can be slightly higher than that of the can lid D.

REFERENCE LIST

1 Press-in tab
2 Rotating lid
3 Support
4 Notch
5 Rivet
6 Press-in tip
7 Pouring opening
8 Fastening tab
9 Lid rim
10 Outer rim of the rotating lid
11 Guide groove
12 Protrusion
13 Reinforcement corrugation
14 Limit stop
15 Operating element
D Can lid
F Force applied
K Can body
S Snap disk

The invention claimed is:

1. A seal for a beverage can, comprising:

a rotating lid (2) that is connected to a rivet (5) in a can lid (D) and is configured to be turned from an open rotating position into a closed rotating position above a pouring opening (7) and back, wherein the rotating lid at least partially takes the form of a bent snap disk (S) that can be moved by the application of force perpendicular to a plane of a lid rim (9), wherein said application of force bends the disk past a trigger point, from one stable first bending state to a stable second bending state in which the outside rim (10) of the rotating lid (2) is pressed with a certain closing force against the lid rim (9) that delimits the pouring opening (7), and from which the snap disk (S) returns to the first bending state by renewed application of force, wherein a press-in tab (1) used for opening which is connected above the rotating lid (2) to the rivet (5) of the can lid (D) as the rotating lid (2), where the rotating lid is held against the lid rim (9) that delimits the pouring opening (7) by a press-in tip (6) of the press-in tab (1), which is pulled up at the end opposite the press-in tip, supported against the can lid (D) and locked, and wherein said rotating lid does not provide an opposite bearing end formed by a lever that radially extends from the rivet and that is located behind the rivet when viewed from the snap disk for said application of force.

2. The seal according to claim 1, wherein at least in the second bending state, the rotating lid (2) extends slightly above or below the lid rim (9) that delimits the pouring opening (7) or projects into it or extends around it.

3. The seal according to claim 1, wherein the rotating lid (2) is attached to a rivet (5) with a fastening tab (8), which extends beyond the rivet (5) as seen from the snap disk (S) to an operating element (15) on the opposite side.

4. The seal according to claim 1, wherein a support (3) is hinged to the end of the press-in tab (1) opposite the press-in tip (6), which can latch downwards into a notch (4) in the can lid (D) once the pouring opening (7) has been pressed open and the rotating lid (2) has been turned over the pouring opening (7), wherein the end of the press-in tab (1) opposite the press-in tip is pulled up, so that the rotating lid (2), which has been moved to the closed rotating position, is pressed against the can lid rim (9) that delimits the pouring opening (7) by the press-in tip (6) of the press-in tab (1).

5. The seal according to claim 4, wherein the support (3) and the press-in tab (1) are made of a single piece, wherein the support is partially cut out of the press-in tab and/or the support (3) is connected to the press-in tab (1) by a folded edge at its end opposite the rivet (5) and/or that the length of the support (3) is smaller than approx. half of the length of the press-in tab (1) and larger than approx. one third of the length of the press-in tab (1) and/or the angle of the press-in tab (1) to a mirror plane is in the latched, locked position between 30° and 45°.

6. The seal according to claim 1, wherein the press-in tab (1) is attached by a fastening tab (8) to the rivet (5), wherein the fastening tab is partially cut out of the press-in tab material.

7. The seal according to claim 4, wherein the rivet (5) and/or the notch (4) are made of the same piece of material as the can lid (D).

8. The seal according to claim 1, wherein an outer rim (10) of the rotating lid (2) and the lid rim (9) that delimits the pouring opening (7) are shaped to form a pressure fitting.

9. The seal according to claim 1, wherein the can rim (3) has a guide groove (11) for holding a protrusion (12) on the bottom of the rotating lid (2).

10. The seal according to claim 1, wherein the rotating lid (2) has reinforcement corrugations (13) near the rivet (5), next to it or on the side opposite the press-in tip (6).

11. The seal according to claim 1, wherein the can lid (D) has a limit stop (14) for the rotating lid (2) in its locked position.

12. The seal according to claim 1, wherein the rotating lid (2) is at least partially coated with sealing material.

13. The seal according to claim 1, wherein the material thickness of the can rim (D) is between 0.1 and 0.3 mm, and/or the material thickness of the press-in tab (1) is between 0.15 and 0.35 mm, and/or the material thickness of the rotating lid (2) is between 0.05 and 0.15 mm.

14. A can lid with a seal according to claim 1.

15. A can with a can lid according to claim 14.

16. The seal according to claim 13, wherein the material thickness of the can rim (D) is approximately 0.224 mm, and/or the material thickness of the press-in tab (1) is approximately 0.265 mm, and/or that the material thickness of the rotating lid (2) is approximately 0.1 mm.

* * * * *